US009539492B1

(12) United States Patent
Eager

(10) Patent No.: US 9,539,492 B1
(45) Date of Patent: Jan. 10, 2017

(54) BILLIARD TRAINING AID

(71) Applicant: Robert H. Eager, Marlborough, MA (US)

(72) Inventor: Robert H. Eager, Marlborough, MA (US)

( * ) Notice: Subject to any disclaimer, the term of this patent is extended or adjusted under 35 U.S.C. 154(b) by 0 days.

(21) Appl. No.: 14/818,890

(22) Filed: Aug. 5, 2015

(51) Int. Cl.
*A63D 15/00* (2006.01)
*A63D 15/10* (2006.01)

(52) U.S. Cl.
CPC ..... *A63D 15/006* (2013.01); *A63D 15/00* (2013.01); *A63D 15/105* (2013.01)

(58) Field of Classification Search
CPC ..... A63D 15/006; A63D 15/00; A63D 15/08
USPC ..... 473/2, 1, 46
See application file for complete search history.

(56) References Cited

U.S. PATENT DOCUMENTS 879,052 A * 2/1908 Jeranek ..... F41A 23/06 182/108
898,345 A * 9/1908 Farnham ..... A63D 15/105 473/42
968,187 A * 8/1910 McIntire ..... A63D 15/105 473/42
2,014,788 A * 9/1935 Strickler ..... A63D 15/00 473/28
2,352,294 A * 6/1944 Stapff ..... A63D 15/105 473/46
2,817,525 A * 12/1957 Niemann ..... A63D 15/10 473/42
3,851,876 A 12/1974 Baker
3,863,376 A * 2/1975 Dalmaso ..... F41A 23/00 42/94
3,947,026 A 3/1976 Scoutten
4,017,997 A * 4/1977 Peterson ..... F41A 23/08 42/94
4,053,153 A * 10/1977 Josenhans ..... A63D 15/105 473/43
4,082,270 A 4/1978 Josenhans
4,147,346 A * 4/1979 Giannetti ..... A63D 15/105 473/43
4,967,497 A * 11/1990 Yakscoe ..... F16M 11/32 42/94
5,154,415 A 10/1992 Zotos
5,181,718 A * 1/1993 Valentine ..... A63D 15/083 473/2
5,275,398 A 1/1994 Compton
D354,106 S * 1/1995 Thompson ..... D21/726
D356,137 S * 3/1995 Hull ..... D22/108
5,853,333 A * 12/1998 Patterson ..... A63D 15/105 473/1
6,132,319 A 10/2000 Schluter
6,267,685 B1 * 7/2001 Cannon ..... A63D 15/105 473/2
6,929,555 B2 * 8/2005 Morton ..... A63D 15/105 473/42

(Continued)

*Primary Examiner* — Mitra Aryanpour
(74) *Attorney, Agent, or Firm* — Richard L. Miller

(57) ABSTRACT

A support that is positioned on either a table or a tripod and holds a cue stick to either train an arm of a billiard player to move in a perfectly straight fashion or to function as a bridge. The support includes a base and a cue stick-moving portion. The base is positioned on either the table or the tripod. The cue stick-moving portion moves relative to the base and holds the cue stick to either train the arm of the billiard player to move in the perfectly straight fashion or to function as the bridge.

50 Claims, 7 Drawing Sheets

(56) References Cited

U.S. PATENT DOCUMENTS

| | | | | |
|---|---|---|---|---|
| 7,611,416 | B1 * | 11/2009 | Mattina | A63D 15/105 473/2 |
| 7,658,680 | B2 | 2/2010 | Malak | |
| 8,523,693 | B2 | 9/2013 | Nelson | |
| 2005/0009613 | A1 | 1/2005 | Davis | |
| 2005/0119058 | A1 * | 6/2005 | Walton | A63D 15/105 473/2 |
| 2008/0125233 | A1 * | 5/2008 | Tucker | A63D 15/006 473/2 |
| 2011/0070959 | A1 * | 3/2011 | Wylie | A63D 15/105 473/2 |
| 2012/0149481 | A1 * | 6/2012 | Christiansen | A63D 15/006 473/2 |

* cited by examiner

BILLIARD TRAINING AID

BACKGROUND OF THE INVENTION

Field of the Invention

The present invention relates to a training aid, and more particularly, a billiard training aid.

Description of the Prior Art

Numerous innovations for billiard training devices have been provided in the prior art that will be described. Even though these innovations may be suitable for the specific individual purposes to which they address, however, they differ from the present invention.

A FIRST EXAMPLE, U.S. Pat. No. 3,851,876, Issued on Dec. 3, 1974, to Baker teaches a training aid-guide device for a pool or billiard cue, which is adapted to be easily held by a user by reason of a configuration featuring a generally rectangular elongate body having a thumb notch in one corner, a palm abutment in spaced opposition, a cue notch above the thumb notch, and a generally flat bottom edge for supporting contact with a pool or billiard table.

A SECOND EXAMPLE, U.S. Pat. No. 3,947,026, Issued on Mar. 30, 1976, to Scoutten teaches a billiard training device (e.g., for games of pool, snooker, or billiards) for simultaneously providing a visual indication of a desired point of aim for a cue ball and a desired point of contact with an object ball, to propel the latter in a predetermined desired direction. The device can be unitary in construction, with a relatively flat indicator surface at substantially one half the height of the cue ball. The indicator surface can also be of the same diameter as the cue ball, and can be provided with indicia to locate both the desired point of contact on the object ball and the desired point of aim for the cue ball. In use, the device is positioned immediately adjacent to an object ball to indicate both the desired point of contact and the point of aim. Through repeated use in practice, a player can learn both the "feel" and principle of correct aim, and thus perfect his playing ability. To facilitate visual training, the device can also be constructed of transparent material.

A THIRD EXAMPLE, U.S. Pat. No. 4,082,270, Issued on Apr. 4, 1978, to Josenhans teaches a training device for determining a theoretical point to aim a billiard ball at a billiard table cushion when attempting a bank shot.

A FOURTH EXAMPLE, U.S. Pat. No. 5,154,415, Issued on Oct. 13, 1992, to Zotos teaches a device including a protractor member attached to a board member at a straight edge of the protractor member. The device attaches to the rail of the table so that the straight edge of the protractor member is directly over the inside edge of the rebound cushion, and can be slid along the rail of the table from side-to-side. There are two weighted posts with draw twines attached at their tops. One of the posts is situated on the table at the exact point that the ball is presently at, while the other post is situated on the table at the exact spot that the ball is to end up after it rebounds off the cushion. Each of the twines is drawn to the center point of the straight edge of the protractor member. This creates a straight line from each post to the center point of the straight edge of the protractor member. The existence of both of these straight lines creates an angle from one post to the center point of the straight edge of the protractor member to the other post that can be seen and identified on the face of the protractor member. As the base is moved from side-to-side on the rail, this angle changes. Guide marks on the protractor member give a measurement of each line from the forward center of the protractor member referred to as the ninety degree point. The base can be moved from side-to-side until both lines are at an equal distance from the ninety degree point. A chalk basin situated on the base, at the center point of the straight edge of the protractor member, is now automatically over that point.

A FIFTH EXAMPLE, U.S. Pat. No. 5,275,398, Issued on Jan. 4, 1994, to Compton teaches an apparatus for use with a pool or billiard table, which includes a stick assembly and arrays of light reflectors attached to the table in parallel with the respective ball-rebounding surfaces. The stick assembly includes a stick and a laser unit connected to the stick. The laser unit includes a housing that is adjustably connected to a bracket that receives the stick. The stick can also include a spring-loaded ram assembly for striking a ball with a predetermined force that results from an amount of energy stored in a compressed spring. A trigger releases the compressed spring permitting the spring to drive the ram to strike a ball. To employ the apparatus for a straight shot, a first ball, which is to be struck by the stick, a second ball, which is to be struck by the first ball, and a target location, such as a pocket, are selected by a player. For the straight shot, as the first ball is struck by the stick, the stick, an aimed light beam, the first ball, the second ball, and the target location are maintained in alignment. To employ the apparatus for a bank shot, a light reflector array is positioned parallel to a ball-rebounding side of the table. For the bank shot, as the first ball is struck by the stick, the stick, the aimed light beam, the first ball, a light reflector, the second ball, and the target location are maintained in alignment.

A SIXTH EXAMPLE, U.S. Pat. No. 6,132,319, Issued on Oct. 17, 2000, to Schluter teaches a billiards training apparatus used in training a user to properly strike a cue ball. The apparatus includes a housing having a front face. The housing is coupled to a striking platform extending a length from the housing. An elongated striker is held in position by at least one support element. The elongated striker has a striking end and a terminal end. Further, the striking end extends out from the front face of the housing and is positioned parallel to the striking platform. At least one lateral movement sensing element is electronically coupled to at least one visual indicia element. The elements are lights in one embodiment of the invention. The elongated striker is positioned to be struck in-line by a cue. The lateral movement sensing element alerts the user to any non-linear movement of the cue relative to the striker.

A SEVENTH EXAMPLE, U.S. Pat. No. 7,658,680, Issued on Feb. 9, 2010, to Malak teaches a cue ball aiming or training device for learning to aim a cue ball to an object ball to drive the object ball in a desired direction. The aiming device provides an indication of the true point of aim for directing a cue ball to an object ball to drive the object ball in a desired direction. In use, the aiming device is positioned on top of the object ball and has a direction indicator to point to the desired intended direction of the object ball and a strike point indicator to identify the true point of aim for the cue ball.

AN EIGHTH EXAMPLE, U.S. Pat. No. 8,523,693, Issued on Sep. 3, 2013, to Nelson teaches a methodology and technology of two billiard balls. Each ball includes nine one quarter inch (¼") lines scribed 360°. The lines are scaled to diamonds on rails of a billiard table. With the aid of the diamonds and lines, it becomes simple for a user and spectators to recognize the type of shot. The training balls provide a tool for improving a user's shot.

A NINTH EXAMPLE, U.S. Patent Office Document No. 2005/0009613, Published on Jan. 13, 2005, to Davis teaches a billiard trainer for promoting accuracy and consistency in contacting an object ball with a cue ball to effect a desired path for the object ball and a resultant path and position for the cue ball. The trainer includes an alignment body supported above the object ball, an object ball laser projecting a forward beam that is positioned on the desired path along a longitudinal axis, an impact indicating laser downwardly projecting a contact line along the object ball for indicating a contact point for the cue ball, a light unit for projecting a ghost ball image on the longitudinal axis at the contact point for indicating the impact position for the cue ball, and a pair of transverse lasers for projecting lateral beams to indicate and reference post impact cue ball position.

It is apparent now that numerous innovations for billiard training devices have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a billiard training aid that avoids the disadvantages of the prior art.

ANOTHER OBJECT of the present invention is to provide a billiard training aid that is simple and inexpensive to manufacture.

STILL ANOTHER OBJECT of the present invention is to provide a billiard training aid that is simple to use.

BRIEFLY STATED, STILL YET ANOTHER OBJECT of the present invention is to provide a support that is positioned on either a table or a tripod and holds a cue stick to either train an arm of a billiard player to move in a perfectly straight fashion or to function as a bridge. The support includes a base and a cue stick-moving portion: The base is positioned on either the table or the tripod. The cue stick-moving portion moves relative to the base and holds the cue stick to either train the arm of the billiard player to move in the perfectly straight fashion or to function as the bridge.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
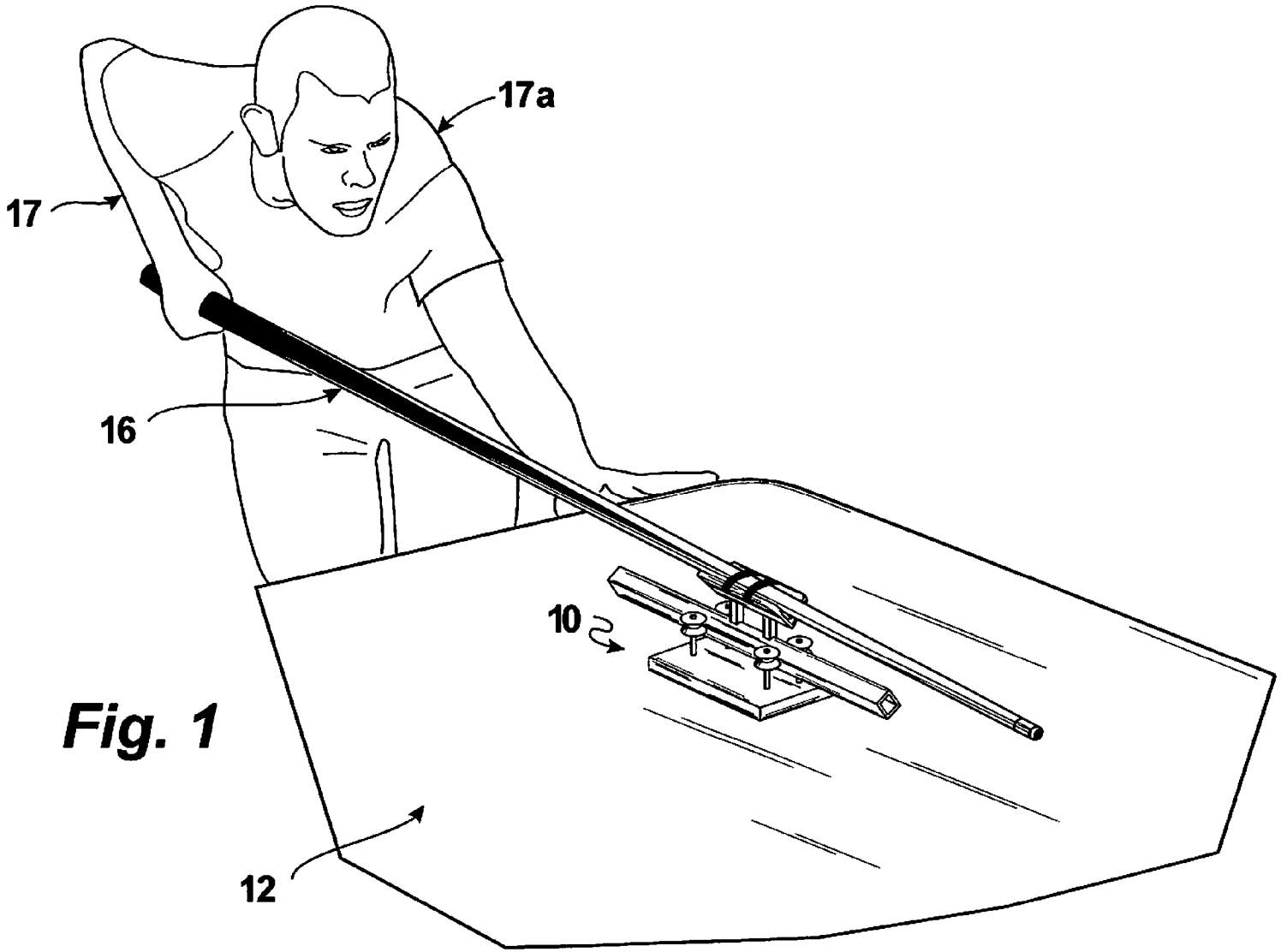
FIG. 1 is a diagrammatic perspective view illustrating a first embodiment of the billiard training aid placed on a cooperating playing table with a pool/billiard stick resting thereon and ready for use by a person.

10 support of embodiments of present invention for positioning on one of pool table 12 and tripod 14 and for holding cue stick 16 for one of training arm 17 of billiard player 17*a* to move in perfectly straight fashion and for functioning as bridge
12 pool table
14 tripod
16 cue stick
17 arm of billiard player 17*a*
17*a* billiard player
18 base for positioning on one of pool table 12 and tripod 14
20 cue stick-moving portion for holding cue stick 16 for one of training arm of billiard player to move in perfectly straight fashion and for functioning as bridge
22 upper surface of base 18
24 plurality of posts of cue stick-moving portion 20
26 plurality of V-wheels of cue stick-moving portion 20
28 slide of cue stick-moving portion 20
30 four axial corner edges of slide 28 of cue stick-moving portion 20
32 plurality of uprights of cue stick-moving portion 20
34 cue stick holder of cue stick-moving portion 20 for receiving cue stick 16
35 midpoint of slide 28
36 protective pad of cue stick-moving portion 20 for preventing damage to cue stick 16 sitting in cue stick holder 34 of cue stick-moving portion 20
38 hook and loop fastener straps of cue stick-moving portion 20 for capturing cue stick 16 in cue stick holder 34 of cue stick-moving portion 20
40 tiltable base 18
42 upper plate of tiltable base 40
44 lower plate of tiltable base 40
45 hinge of tiltable base 40
46 twistable locking mechanism
48 track
50 block

DETAILED DESCRIPTION OF THE PREFERRED EMBODIMENT

Figure 2:
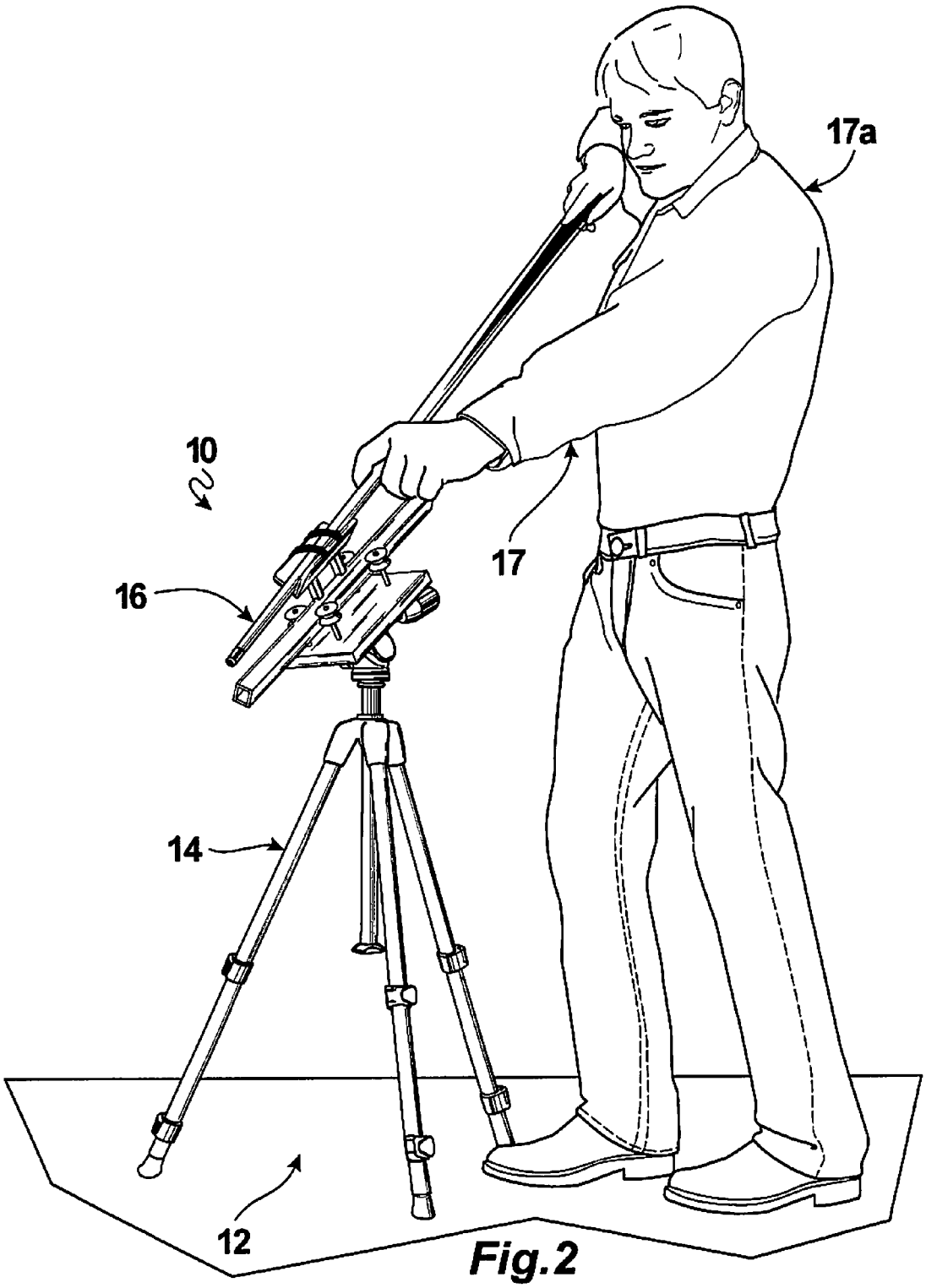
FIG. 2 is a diagrammatic perspective view illustrating a first embodiment of the billiard training aid placed on a cooperating tripod with a pool/billiard stick resting thereon and ready for use by a person.
Figure 3:
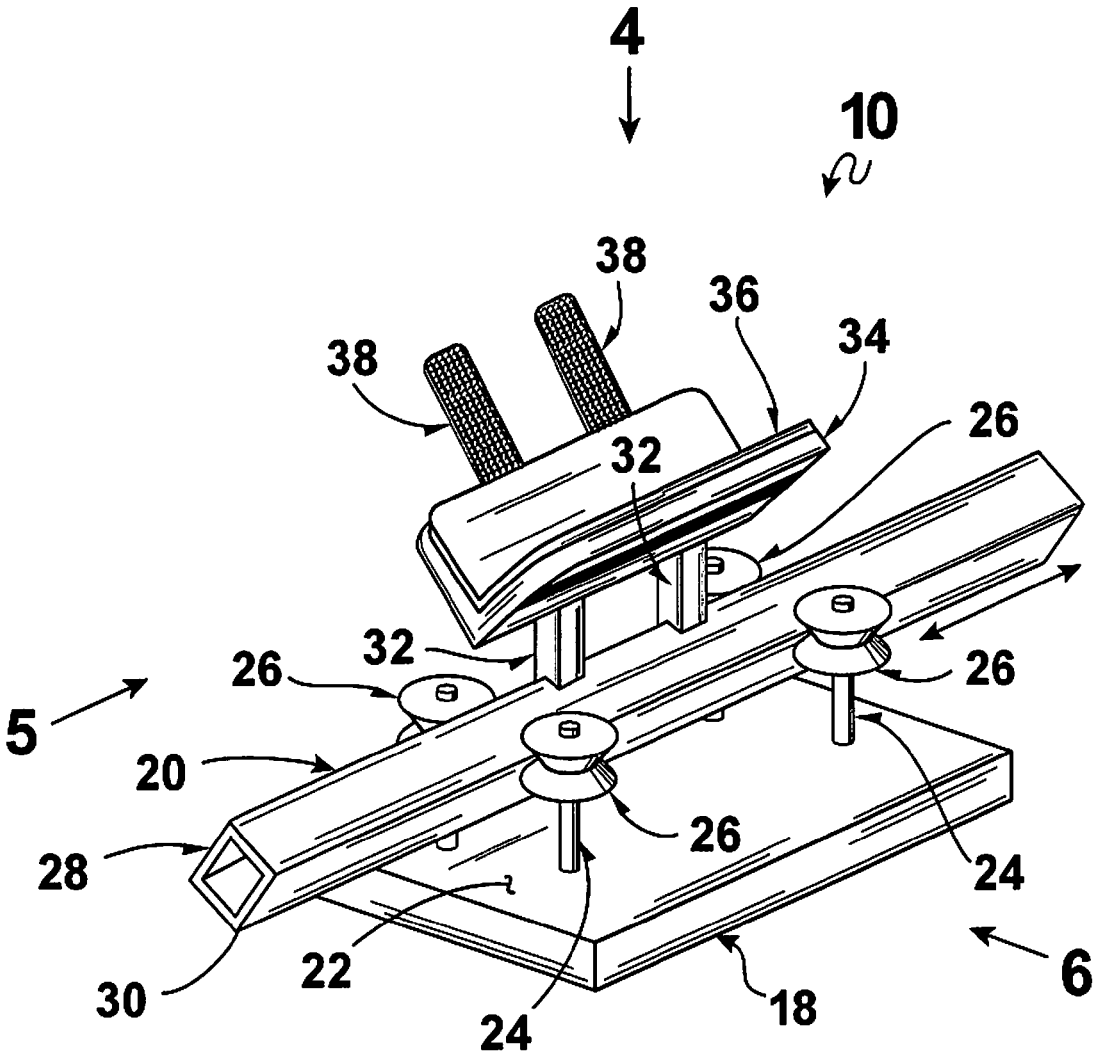
FIG. 3 is a diagrammatic perspective view illustrating a first embodiment of the billiard training aid pro se.
Figure 4:
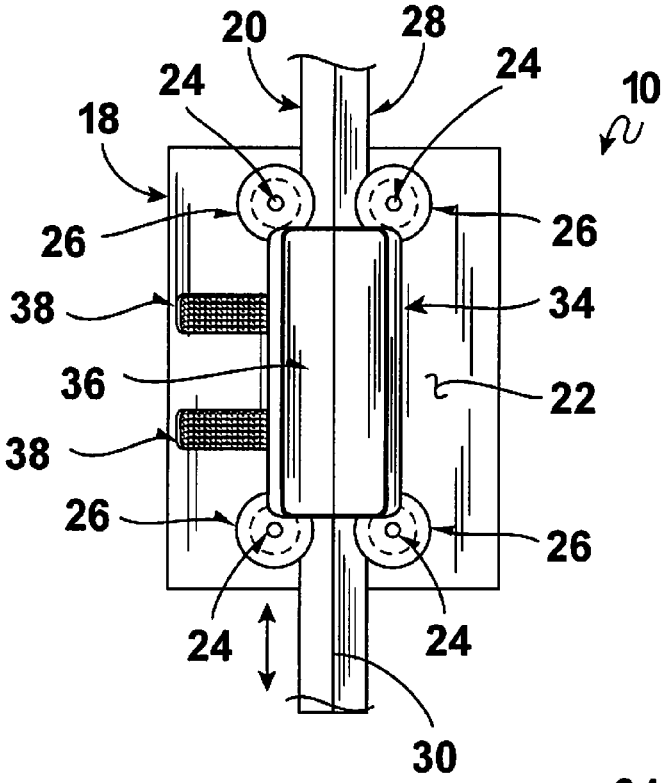
FIG. 4 is a top plan view thereof, taken in the direction of arrow 4 in FIG. 3.
Figure 5:
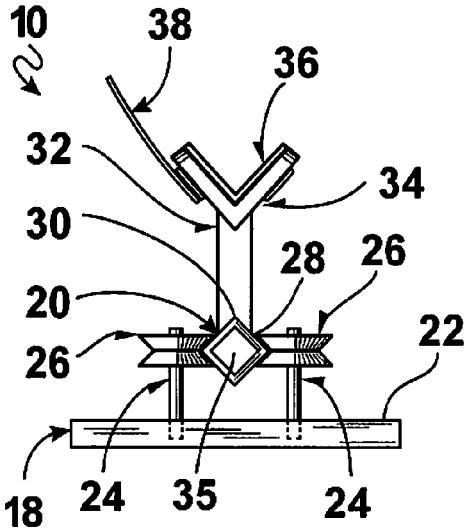
FIG. 5 is an end elevational view thereof, taken in the direction of arrow 5 in FIG. 3, the opposite end being a mirror image thereof.
Figure 6:
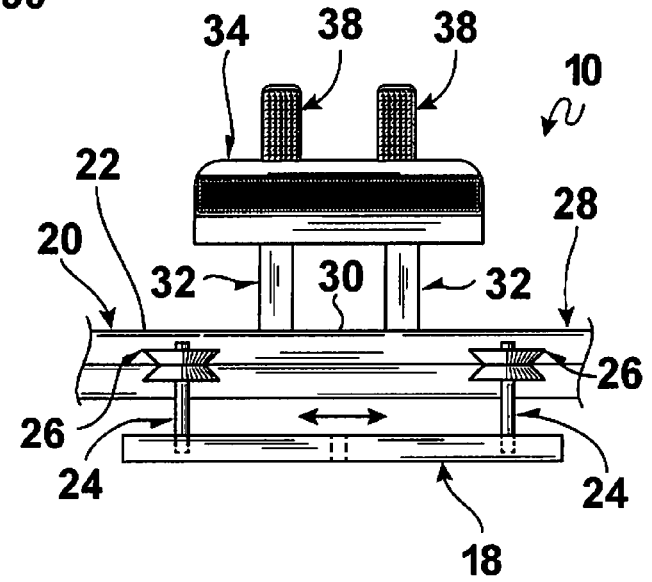
FIG. 6 is a side elevational view thereof, taken in the direction of arrow 6 in FIG. 3, the opposite side being a mirror image thereof.
Figure 7:
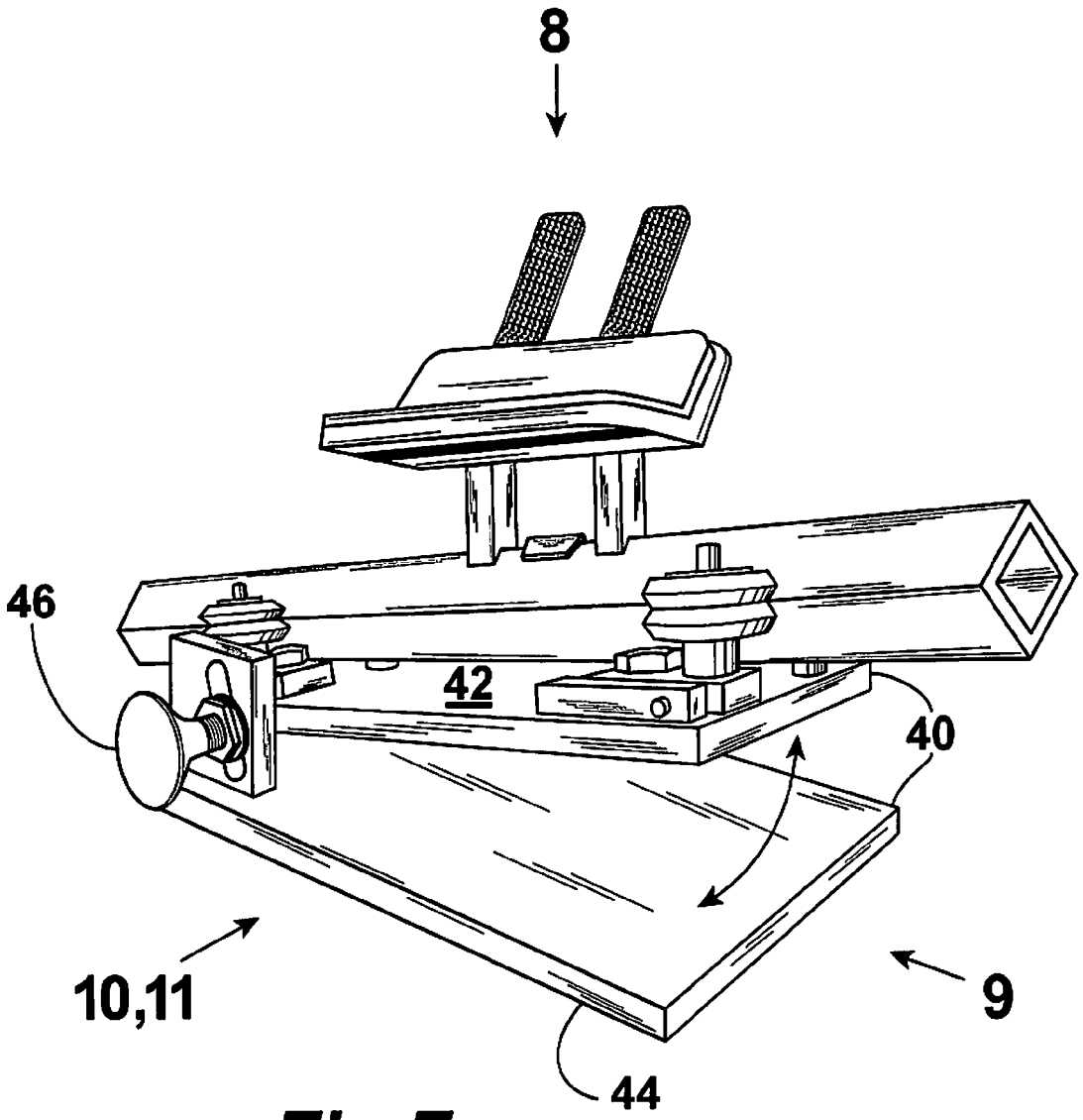
FIG. 7 is a diagrammatic perspective view of a second embodiment of a billiard training aid illustrating a tiltable base.
Figure 8:
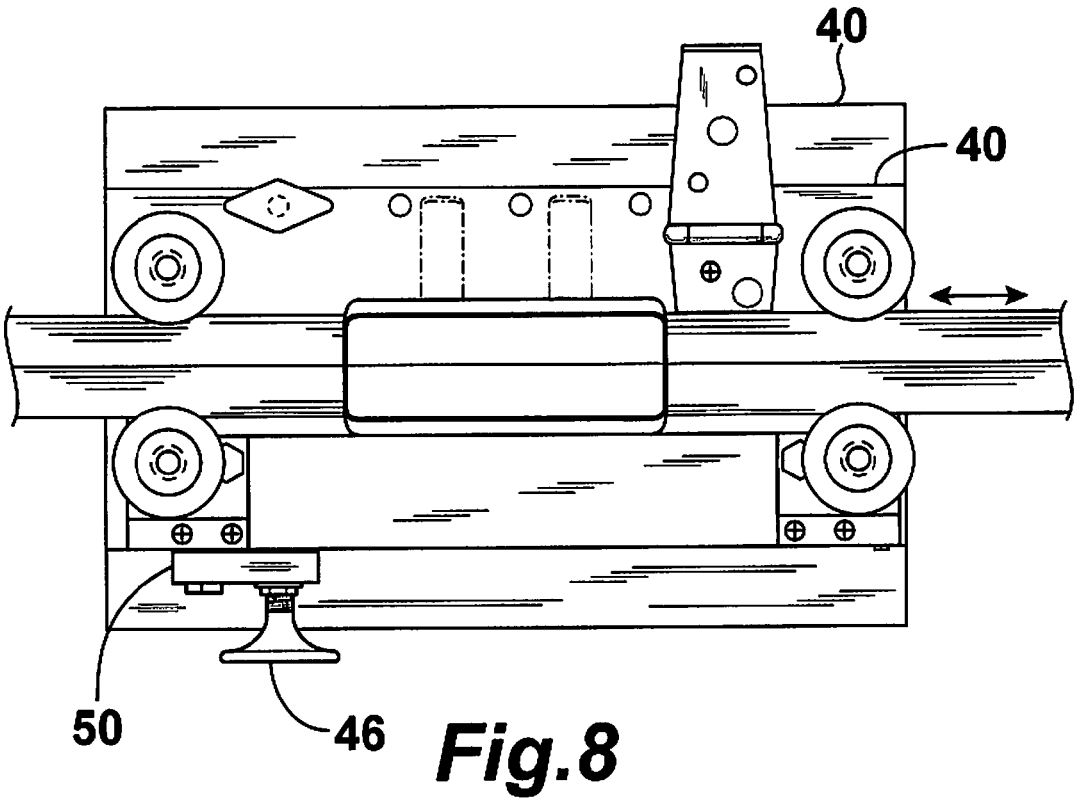
FIG. 8 is a top plan view thereof taken in the direction of arrow 8 in FIG. 7.
Figure 9:
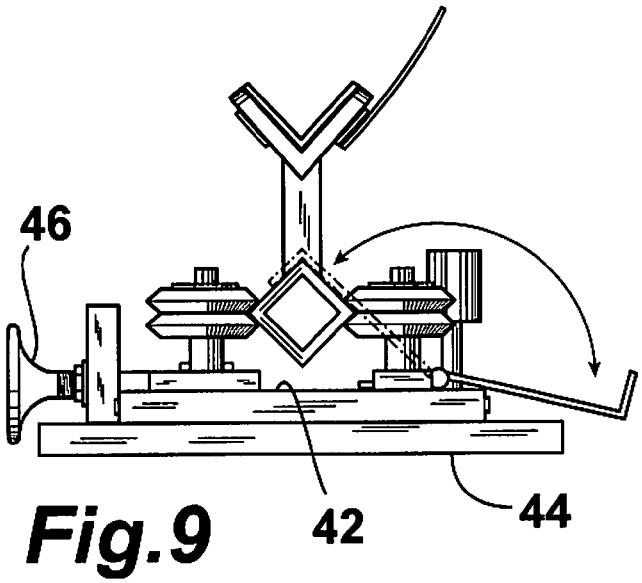
FIG. 9 is a front elevational view thereof taken in the direction of arrow 9 in FIG. 1 and illustrating a catch for holding the slide of the billiard aid in place.
Figure 10:
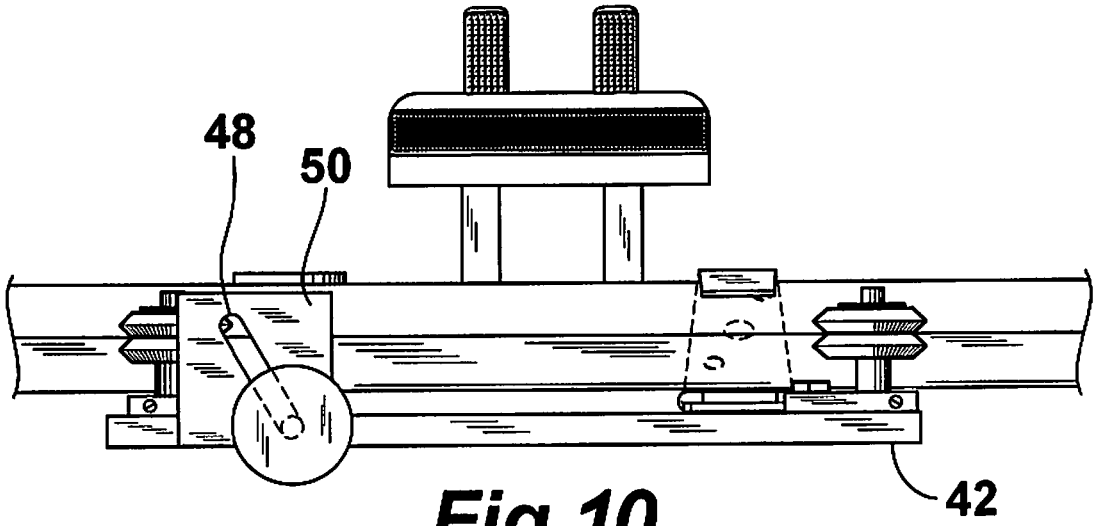
FIG. 10 is a left side elevational view taken in the direction of arrow 10 in FIG. 7 with parts broken away illustrating just the upper plate.
Figure 11:
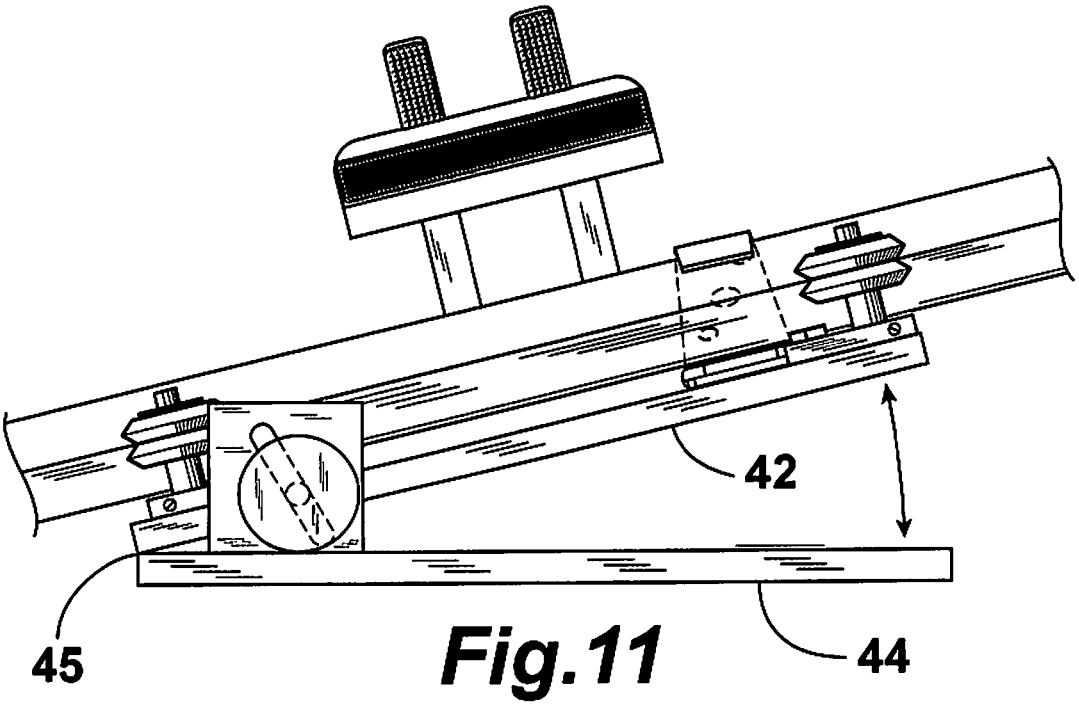
FIG. 11 is a left side elevational view taken in the direction of arrow 10 in FIG. 7 with the base of the invention tilted in respect to the tiltable adjustment member.

Referring now to the figures, in which like numerals indicate like parts, and particularly to FIGS. 1 and 2, the support of the embodiments of the present invention is shown generally at 10 for positioning on one of a table 12 (FIG. 1) and a tripod 14 (FIG. 2) and for holding a cue stick 16 for one of training an arm 17 of a billiard player 17*a* to move in a perfectly straight fashion and for functioning as a bridge.

The configuration of the support 10 can best be seen in FIGS. 3-6, and as such, will be discussed with reference thereto.

The support 10 comprises a base 18 and a cue stick-moving portion 20. The base 18 is for positioning on one of the table 12 and the tripod 14. The cue stick-moving portion 20 moves relative to the base 18 and is for holding the cue stick 16 for one of training the arm 17 of the billiard player 17*a* to move in the perfectly straight fashion and for functioning as the bridge.

The base 18 is generally rectangular-parallelepiped-shaped, has an upper surface 22, and is made from aluminum.

The cue stick-moving portion 20 includes a plurality of posts 24.

The plurality of posts 24 of the cue stick-moving portion 20 are parallel to each other, extend vertically upwardly from the upper surface 22 of the base 18, are spaced-apart from each other, are disposed at corners of a rectangle, are four in number, are identical to each other, and are made from aluminum.

The cue stick-moving portion 20 further includes a plurality of V-wheels 26.

The plurality of V-wheels 26 of the cue stick-moving portion 20 extend horizontally rotatably from the plurality of posts 24 of the cue stick-moving portion 20, respectively, are at a same elevation, are identical to each other, and are made from DELRIN® with steel bearings.

The cue stick-moving portion 20 further includes a slide 28.

The slide 28 of the cue stick-moving portion 20 is a box tube, and as such, has a square cross section, is hollow, and has four axial corner edges 30, is straight, is horizontally oriented, extends movably between pairs of the plurality of V-wheels 26 of the cue stick-moving portion 20, operatively engage the plurality of V-wheels 26 of the cue stick-moving portion 20 so as to allow the slide 28 of the cue stick-moving portion 20 to move forward and backward relative to the plurality of V-wheels 26 of the cue stick-moving portion 20, and is turned 45° relative to the base 18 so as to allow two of the four axial corner edges 30 of the slide 28 of the cue stick-moving portion 20 to operatively engage the plurality of V-wheels 26 of the cue stick-moving portion 20.

The cue stick-moving portion 20 further includes a plurality of uprights 32.

The plurality of uprights 32 of the cue stick-moving portion 20 are spaced-apart from each other, are identical to each other, are parallel to each other, are aligned with each other, are perpendicular to the slide 28 of the cue stick-moving portion 20, are two in number, straddle a midpoint 35 of the slide 28 of the cue stick-moving portion 20, extend vertically upwardly from, and move with, a highestmost corner of the four axial corner edges 30 of the slide 28 of the cue stick-moving portion 20, and are made from aluminum.

The cue stick-moving portion 20 further includes a cue stick holder 34.

The cue stick holder 34 of the cue stick-moving portion 20 is V-shaped in lateral cross section, extends along, and moves with, the plurality of uprights 32 of the cue stick-moving portion 20 for one of training the arm 17 of the billiard player 17*a* to move in the perfectly straight fashion and for functioning as the bridge, is parallel to the slide 28 of the cue stick-moving portion 20, is made from aluminum, and is for receiving the cue stick 16.

The cue stick-moving portion 20 further includes a protective pad 36.

The protective pad 36 of the cue stick-moving portion 20 lines the cue stick holder 34 of the cue stick-moving portion 20, and is for preventing damage to the cue stick 16 sitting in the cue stick holder 34 of the cue stick-moving portion 20.

The cue stick-moving portion 20 further includes hook and loop fastener straps 38 (VELCRO®).

The hook and loop fastener straps 38 of the cue stick-moving portion 20 extend from the cue stick holder 34 of the cue stick-moving portion 20, and are for replaceably capturing the cue stick 16 in the cue stick holder 34 of the cue stick-moving portion 20.

In a second embodiment, the base 18 is a tiltable base 40. The tiltable base 40 is for allowing the support 10 to be operated at an angle. The tiltable base 40 comprises an upper plate 42 and a lower plate 44. The upper plate 42 is tiltable with respect to the lower plate 44.

To accomplish this, the upper plate 42 is connected to the lower plate 44 by a hinge 45. The base further comprises a locking mechanism 46, which locking mechanism 46 is for fixing the angle at which the upper plate 42 is tilted in respect to the lower plate 44. In a preferred construction, the locking mechanism 46 is a twistable locking mechanism 46, and the locking mechanism 46 travels in a track 48. The track 48 comprises a bore in a block 50, and the bore is substantially linear. The block 50 is fixedly attached to the lower plate 44.

The upper plate 42 and the lower plate 44 are both substantially rectangular parallelepiped shaped. The lower plate 44 has a length and a width. The length of the lower plate 44 is greater than the width of the lower plate 44. The upper plate 42 has a length and a width. The width of the upper plate 42 is less than the width of the lower plate 44.

It will be understood that each of the elements described above, or two or more together, may also find a useful application in other types of constructions differing from the types described above.

While the invention has been illustrated and described as embodiments of a billiard training aid, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A support for positioning on one of a table and a tripod and for holding a cue stick for one of training an arm of a billiard player to move in a perfectly straight fashion and for functioning as a bridge, said support comprising:

a) a base; and b) a cue stick-moving portion;

wherein said base is for positioning on one of the table and the tripod;

wherein said cue stick-moving portion moves relative to said base; and wherein said cue stick-moving portion is for holding the cue stick for one of training the arm of the billiard player to move in the perfectly straight fashion and for functioning as the bridge;

wherein said base has an upper surface;

wherein said cue stick-moving portion includes a plurality of posts;

wherein said cue stick-moving portion includes a plurality of V-wheels.

2. The support of claim 1, wherein said base is generally rectangular-parallelepiped-shaped.

3. The support of claim 1, wherein said base is made from aluminum.

4. The support of claim 1, wherein said plurality of posts of said cue stick-moving portion are parallel to each other.

5. The support of claim 1, wherein said plurality of posts of said cue stick-moving portion extend vertically upwardly from said upper surface of said base.

6. The support of claim 1, wherein said plurality of posts of said cue stick-moving portion are spaced-apart from each other.

7. The support of claim 1, wherein said plurality of posts of said cue stick-moving portion are disposed at corners of a rectangle.

8. The support of claim 1, wherein said plurality of posts of said cue stick-moving portion are four in number.

9. The support of claim 1, wherein said plurality of posts of said cue stick-moving portion are identical to each other.

10. The support of claim 1, wherein said plurality of posts of said cue stick-moving portion are made from aluminum.

11. The support of claim 1, wherein said plurality of V-wheels of said cue stick-moving portion extend horizontally from said plurality of posts of said cue stick-moving portion, respectively.

12. The support of claim 1, wherein said plurality of V-wheels of said cue stick-moving portion extend rotatably from said plurality of posts of said cue stick-moving portion, respectively.

13. The support of claim 1, wherein said plurality of V-wheels of said cue stick-moving portion are at a same elevation.

14. The support of claim 1, wherein said plurality of V-wheels of said cue stick-moving portion are identical to each other.

15. The support of claim 1, wherein said plurality of V-wheels of said cue stick-moving portion have steel bearings.

16. The support of claim 1, wherein said cue stick-moving portion includes a slide.

17. The support of claim 16, wherein said slide of said cue stick-moving portion is a box tube.

18. The support of claim 16, wherein said slide of said cue stick-moving portion has a square cross section.

19. The support of claim 16, wherein said slide of said cue stick-moving portion is hollow.

20. The support of claim 16, wherein said slide of said cue stick-moving portion has four axial corner edges.

21. The support of claim 16, wherein said slide of said cue stick-moving portion is straight.

22. The support of claim 16, wherein said slide of said cue stick-moving portion is horizontally oriented.

23. The support of claim 16, wherein said slide of said cue stick-moving portion movably extends between pairs of said plurality of V-wheels of said cue stick-moving portion.

24. The support of claim 16, wherein said slide of said cue stick-moving portion operatively engage said plurality of V-wheels of said cue stick-moving portion so as to allow said slide of said cue stick-moving portion to move forward and backward relative to said plurality of V-wheels of said cue stick-moving portion.

25. The support of claim 16, wherein said slide of said cue stick-moving portion is turned 45° relative to said base so as to allow two of said four axial corner edges of said slide of said cue stick-moving portion to operatively engage said plurality of V-wheels of said cue stick-moving portion.

26. The support of claim 20, wherein said cue stick-moving portion includes a plurality of uprights.

27. The support of claim 26, wherein said plurality of uprights of said cue stick-moving portion are spaced-apart from each other.

28. The support of claim 26, wherein said plurality of uprights of said cue stick-moving portion are identical to each other.

29. The support of claim 26, wherein said plurality of uprights of said cue stick-moving portion are parallel to each other.

30. The support of claim 26, wherein said plurality of uprights of said cue stick-moving portion are aligned with each other.

31. The support of claim 26, wherein said plurality of uprights of said cue stick-moving portion are perpendicular to said slide of said cue stick-moving portion.

32. The support of claim 26, wherein said plurality of uprights of said cue stick-moving portion are two in number.

33. The support of claim 26, wherein said plurality of uprights of said cue stick-moving portion straddle a mid-point of said slide of said cue stick-moving portion.

34. The support of claim 26, wherein said plurality of uprights of said cue stick-moving portion extend vertically upwardly from, and move with, a highestmost corner of said four axial corner edges of said slide of said cue stick-moving portion.

35. The support of claim 26, wherein said plurality of uprights of said cue stick-moving portion are made from aluminum.

36. The support of claim 26, wherein said cue stick-moving portion includes a cue stick holder; and wherein said cue stick-moving portion is for receiving the cue stick.

37. The support of claim 36, wherein said cue stick holder of said cue stick-moving portion is V-shaped in lateral cross section.

38. The support of claim 36, wherein said cue stick holder of said cue stick-moving portion extends along, and moves with, said plurality of uprights of said cue stick-moving portion for training the arm of the billiard player to move in the perfectly straight fashion and for functioning as the bridge.

39. The support of claim 36, wherein said cue stick holder of said cue stick-moving portion is parallel to said slide of said cue stick-moving portion.

40. The support of claim 36, wherein said cue stick holder of said cue stick-moving portion is made from aluminum.

41. The support of claim 36, wherein said cue stick-moving portion includes a protective pad.

42. The support of claim 41, wherein said protective pad of said cue stick-moving portion lines said cue stick holder of said cue stick-moving portion; and wherein said protective pad of said cue stick-moving portion is for preventing damage to the cue stick sitting in said cue stick holder of said cue stick-moving portion.

43. The support of claim 36, wherein said cue stick-moving portion includes hook and loop fastener straps; and wherein said hook and loop fastener straps of said cue stick-moving portion are for replaceably capturing the cue stick in said cue stick holder of said cue stick-moving portion.

44. The support of claim 43, wherein said hook and loop fastener straps of said cue stick-moving portion extend from said cue stick holder of said cue stick-moving portion.

45. A support for positioning on one of a table and a tripod and for holding a cue stick for one of training an arm of a billiard player to move in a perfectly straight fashion and for functioning as a bridge, said support comprising:

a) a base; and b) a cue stick-moving portion;

wherein said base is for positioning on one of the table and the tripod;

wherein said cue stick-moving portion moves relative to said base; and wherein said cue stick-moving portion is for holding the cue stick for one of training the arm of the billiard player to move in the perfectly straight fashion and for functioning as the bridge;

wherein said base comprises a tiltable base;

wherein said tiltable base is for allowing the support to be operated at an angle;

wherein said tiltable base comprises an upper plate and a lower plate; and wherein said upper plate is tiltable with respect to said lower plate;

wherein said locking mechanism is a twistable locking mechanism; and wherein said locking mechanism travels in a track.

46. The support of claim 45 wherein said upper plate is connected to said lower plate by a hinge.

47. The support of claim 45 wherein said base further comprises a locking mechanism; and wherein said locking mechanism is for fixing the angle at which the upper plate is tilted with respect to the lower plate.

48. The support of claim 45 wherein said track comprises a bore in a block; and wherein said bore is substantially linear.

49. The support of claim 48 wherein said block is fixedly attached to said lower plate.

50. The support of claim 49 wherein said upper plate and said lower plate are both substantially rectangular parallelepiped shaped;

wherein said lower plate has a length and a width;

wherein said length of said lower plate is greater than said width of said lower plate;

wherein said upper plate has a length and a width; and wherein said width of said upper plate is less than said width of said lower plate.

* * * * *